US005964218A

United States Patent [19]

Smith et al.

[11] Patent Number: 5,964,218

[45] Date of Patent: Oct. 12, 1999

[54] FACE MASK WITH BACK-UP SMOKE INHALATION PROTECTION AND METHOD OF OPERATION

[75] Inventors: Dennis Smith, Southampton, N.Y.; Karen Nelson, Palm Beach Gardens; Frances G. Morton, North Palm Beach, both of Fla.

[73] Assignee: Lifepro, Inc., West Palm Beach, Fla.

[21] Appl. No.: 08/652,664

[22] Filed: May 28, 1996

Related U.S. Application Data

[63] Continuation-in-part of application No. 08/379,339, Jan. 27, 1995, Pat. No. 5,524,616, which is a continuation-in-part of application No. 08/299,926, Aug. 31, 1994, abandoned.

[51] Int. Cl.[6] ..... A62B 7/10

[52] U.S. Cl. ..... 128/201.25; 128/202.22; 128/206.17; 128/205.23

[58] Field of Search ..... 128/202.22, 201.25, 128/205.27, 206.17, 205.23

[56] References Cited

U.S. PATENT DOCUMENTS

| | | | |
|---|---|---|---|
| 1,537,519 | 5/1925 | Yablick | 422/119 |
| 2,450,610 | 10/1948 | Pierce | 128/205.27 |
| 2,610,624 | 9/1952 | Haller et al. | 128/205.29 |
| 3,653,581 | 4/1972 | Ptok | 206/497 |
| 3,731,678 | 5/1973 | Pyzel | 128/202.26 |
| 3,908,649 | 9/1975 | Eckstein | 128/201.13 |
| 4,154,235 | 5/1979 | Warncke | 128/201.25 |
| 4,154,586 | 5/1979 | Jones et al. | 55/274 |
| 4,155,358 | 5/1979 | McAllister et al. | 128/202.22 |
| 4,276,982 | 7/1981 | Sibrara et al. | 206/439 |
| 4,467,795 | 8/1984 | Eckstein | 128/201.25 |
| 4,468,811 | 8/1984 | Shaw et al. | 383/5 |
| 4,473,072 | 9/1984 | Walther | 128/201.25 |
| 4,475,661 | 10/1984 | Griffin | 215/366 |
| 4,488,547 | 12/1984 | Mason | 128/202.22 |
| 4,562,837 | 1/1986 | Schlobohm | 128/206.17 |
| 4,726,365 | 2/1988 | Jablonski | 128/202.13 |
| 4,745,730 | 5/1988 | Bastle, Sr. | 53/405 |

(List continued on next page.)

FOREIGN PATENT DOCUMENTS

| | | |
|---|---|---|
| 1434909 | 10/1968 | Germany . |
| 1282469 | 7/1969 | Germany . |
| 2926728 | 2/1981 | Germany . |
| 2609034 B2 | 4/1981 | Germany . |
| 2948423 C2 | 12/1982 | Germany . |
| 3405098 A1 | 8/1985 | Germany . |
| 3507486 C2 | 1/1987 | Germany . |
| 4220780 C1 | 9/1993 | Germany . |
| 2223683 | 4/1990 | United Kingdom . |

OTHER PUBLICATIONS

Drager Review 27 pp. 6–8.
Drager Review 10 pp. 20–23.

(List continued on next page.)

*Primary Examiner*—Aaron J. Lewis
*Attorney, Agent, or Firm*—Quarles & Brady

[57] ABSTRACT

A self-contained breathing apparatus for emergency response personnel has face mask with a first port connected by a hose to a tank of compressed air. Back-up smoke inhalation protection is provided for imminent life-threatening situations by configuring a face mask with a canister containing a filter medium, an inlet opening through which air enters and an outlet coupling for attachment to a second port of the face mask. In normal situations the mask is supplied with air from the tank, but should the tank supply become depleted, the canister can be activated. A use-evidencing mechanism is operatively connected to the canister to indicate use of the air filtering system. This mechanism may be a non-reusable cover applied over the inlet opening and/or a valve in the second port of the face mask with a portion that breaks away upon opening of the valve. Such mechanisms provide an indication of previous use of the filtering system and inhibit a fire fighter from using the system in an unauthorized manner, in less than an imminent life-threatening situation.

18 Claims, 2 Drawing Sheets

U.S. PATENT DOCUMENTS

| | | | |
|---|---|---|---|
| 4,818,120 | 4/1989 | Addiego | 383/5 |
| 4,926,398 | 5/1990 | Finehes | 367/172 |
| 4,926,854 | 5/1990 | Bode | 128/201.23 |
| 4,934,361 | 6/1990 | Michel et al. | 128/206.17 |
| 5,005,700 | 4/1991 | Rohling et al. | 206/459.1 |
| 5,007,421 | 4/1991 | Stewart | 128/204.18 |
| 5,186,165 | 2/1993 | Swann | 128/201.28 |
| 5,291,880 | 3/1994 | Almovist et al. | 128/201.22 |
| 5,524,616 | 6/1996 | Smith et al. | 128/205.27 |
| 5,562,092 | 10/1996 | George | 128/201.25 |

OTHER PUBLICATIONS

Drager Review 40 pp. 1–8.
Drager Review 9 pp. 12–16.
Drager Review 31 pp. 8–16, Sep. 1973.
Drager Review 32 pp. 28–33.
Drager Review 25 pp. 12–15.
Drager Review 23 pp. 17–20 Sep. 1970.
Drager Review 25 pp. 1–9.
Lab Safety Supply, 1994 General Catalog, Winter/Spring Edition.
MSA Ultravne/Ultra–Twin Facepiece Owner's Manual, pp. 18–20 (1996).

FACE MASK WITH BACK-UP SMOKE INHALATION PROTECTION AND METHOD OF OPERATION

CROSS REFERENCE TO RELATED APPLICATIONS

This is a continuation-in-part of U.S. patent application Ser. No. 08/379,339, filed Jan. 27, 1995, now U.S. Pat. No. 5,524,616; which is a continuation-in-part of U.S. patent application Ser. No. 08/299,926, filed Aug. 31, 1994, now abandoned.

BACKGROUND OF THE INVENTION

The present invention relates to fire fighting safety equipment and methods, and more particularly to those for protecting fire fighters against smoke inhalation in imminently life-threatening situations.

Breathing masks are often worn by workers in hazardous environments. One type of such a mask extends only over a user's nose and mouth, and contains a charcoal filter through which the air being breathed passes. The filter removes particles and toxic materials from the air. However, use of this type of breathing apparatus is typically prohibited by most fire departments as being inadequate, unreliable or unsafe in many environments where fire and smoke are present.

Instead, emergency response personnel, such as fire fighters, are commonly approved to use safer self-contained breathing equipment when entering burning buildings. Such equipment includes a tank of compressed air and a pressure regulator to supply air at a constant pressure which can be tolerated by the fire fighter. A hose connects the air regulator to a full-face mask that is worn over the fire fighter's face. The mask includes an outlet for air exhaled by the fire fighter and a transparent visor. When worn by the user, the mask not only provides a sealed volume of breathable air over the user's face, but also protects the fire fighter's eyes from ambient smoke. Self-contained breathing apparatus with a full-face mask typically is the only type of smoke inhalation prevention equipment that is authorized by a fire department.

The tank of the fire fighter's breathing equipment has a finite supply of air. Although warning mechanisms are provided to alert the fire fighter when the supply of air is running low, there always is the possibility that the fire fighter will not be able to exit a burning structure before depletion of the air supply. There is also a possibility that a fire fighter may become trapped within a burning structure, due to structure collapse, for example, or may become lost in a large smoke-filled area, such as a shopping mall. The fire fighter could also be injured or incapacitated in someway and rendered immobile. In these instances, the fire fighter can run out of breathable air and be in imminent danger of death. As a consequence, it is desirable to provide an alternative breathing apparatus that protects against smoke inhalation for use in such imminent life-threatening emergencies.

Although a charcoal-type mouth filter could be provided to fire fighters for emergency back-up to authorized self-contained breathing apparatus, fire department officials are often concerned that such devices will be used routinely in the normal course of fire fighting and not reserved for imminent death situations, and therefore officials prohibit their use outright. Accordingly, it is desirable to provide a way of issuing back-up breathing devices to fire fighters in a manner which restricts their use to true emergency imminent death situations. It is also desirable to provide a mechanism by which fire fighters can quickly identify previous use and fire department officials can detect the unauthorized use of such emergency breathing devices.

Various methods and apparatus for providing backup breathing opportunity to fire fighters in truly emergency imminent death situations are set forth in applicant's U.S. Pat. No. 5,524,616, the disclosure of which is incorporated by reference herein.

SUMMARY OF THE INVENTION

A general object of the present invention is to provide a reliable emergency breathing system and a method to protect fire fighters from smoke inhalation in last resort, imminent death situations in a manner that inhibits use of such equipment in the ordinary course of fire fighting.

Another object is to provide a use-evidencing container to employ in an emergency breathing method which provides a clear indication that the apparatus has been used.

Yet another object of the present invention is to provide a further improved apparatus for use in the patented method of emergency air filtering that alleviates mounting and manipulation requirements yet maintains the use-evidencing advantages of the invention.

A further object of the invention is to provide a method of emergency air filtering that can be utilized quickly by an endangered fire fighter.

These objects are achieved by an emergency air filtering apparatus for protecting a fire fighter from smoke and hazardous chemical inhalation in imminent life-threatening situations. It is recognized that all fire fighting experiences are life-threatening to varying degrees. As used throughout this specification and associated claims, the terms "imminent death situations" and "imminently life-threatening" mean those instances during fire fighting in which a fire fighter realizes that circumstances have placed him in imminent and impending danger of death. These terms are intended to distinguish from the ordinary course of normal fire fighting in which a fire fighter is aware of options and opportunities to remain secure against death while performing his fire fighting tasks.

To further enhance the readily available nature of the emergency smoke filtration system according to the invention, the improved apparatus provides a back-up smoke filter secured to the face mask of a conventional self-contained breathing system. The back-up smoke filter is activated by a switch, valve or other mechanism for transferring airflow from a source of breathable air to passage through the smoke filter. The critical use-evidencing construction of the invention is provided to the switch or transfer mechanism to evidence when such change in the air passage is made.

The switching mechanism and its use-evidencing configuration can be constructed in a variety of manners. For example, the improved smoke filter system can use a multi-port face mask having a central port for receiving a hose from a source of breathable air such as a tank of compressed air and one or more lateral ports for the attachment of smoke filters. Multi-port filter masks which can be adapted for use with the present invention are known, such as for example the Ultra-Twin® model manufactured by MSA International of Pittsburgh, Pa., U.S.A.

The use of a manual switch or valve can be configured to evidence its use through various mechanisms. One example can include a cover of plastic or tape that is broken upon actuation of the switch. Alternatively and more durably, a plate can slide in a groove that is transverse to the air passage. When the plate is positioned to block the air passage, break-away tabs on the plate engage notches in the groove wall so that the plate is held in the closed state. When the plate is manipulated by the fire fighter to activate the air filtering device and open its air passage, the tabs break off thereby providing an indication the that device has been used. Replacement of the switch plate to its original position cannot return the tabs to their originally unbroken condition. This mechanism for use-evidencing is preferred because the tabs are not readily subject to breaking and tearing as in the case of tape or covers during normal use of the mask in handling during equipment management by the fire fighter or his department.

The present invention allows the prior use of the breathing device to be visually detected and to be monitored by fire fighter supervising personnel, thereby discouraging unauthorized use for other than imminent death situations. In addition, the use indicia also indicate that the filter material should be replaced as its ability to remove hazardous substances may be depleted.

DETAILED DESCRIPTION OF THE INVENTION

The invention is directed to a method for providing fire fighters with an emergency device for supplying breathable air when a standard breathing source such as a self-contained breathing apparatus is exhausted. This method is intended to provide the fire fighter a few extra minutes of breathing to escape imminently life threatening situations. The invention also resides in the step of configuring the breathing device to be use-evidencing so as to provide an accountability of the use by the fire fighter.

Figure 1:
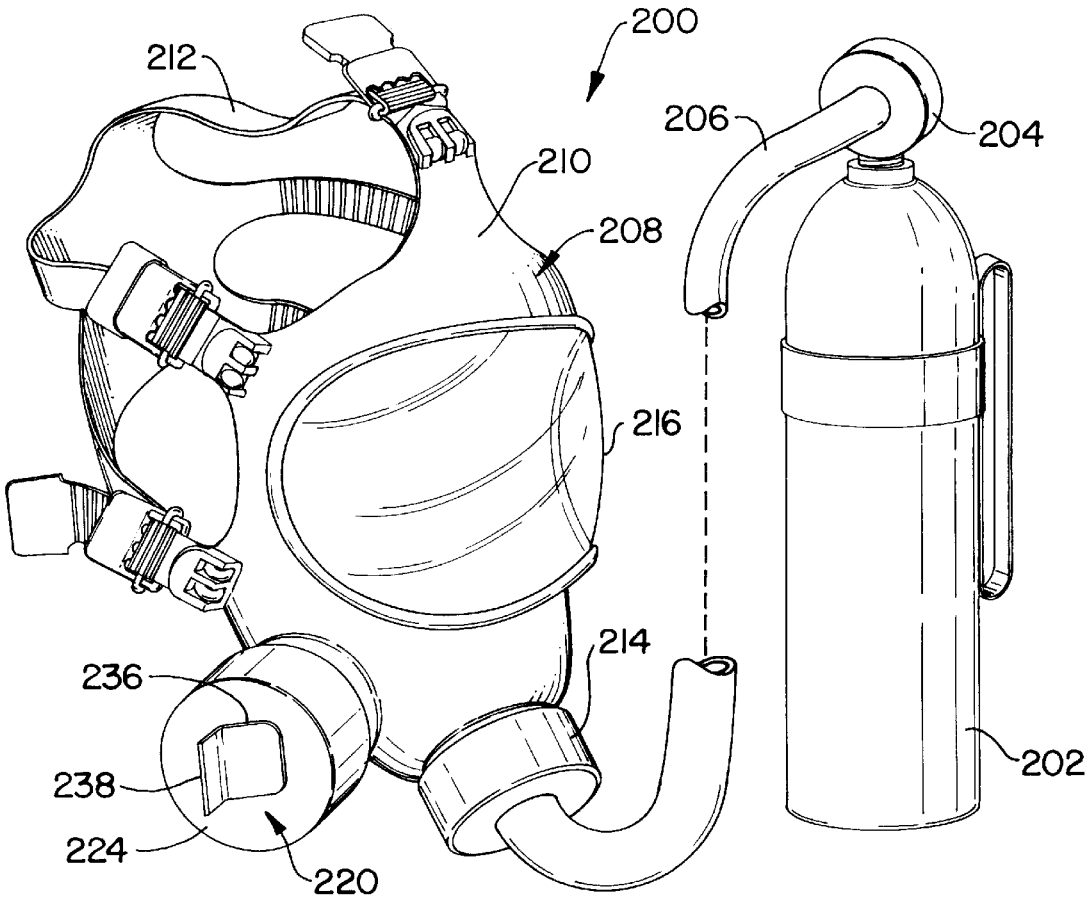
FIG. 1 is a pictorial view of an embodiment of a mask of a conventional self contained breathing apparatus which incorporates the present invention.

The method can be accomplished, for example, by employing an emergency personal air filtering device with conventional fire fighter breathing equipment 200, such as the one shown in FIG. 1.

The apparatus includes a tank 202 of compressed air that is dispensed through a pressure regulator 204 into hose 206. The hose 206 extends from the regulator 204 to a face mask 208 which is formed by a rubber semi-hood 210 adapted to extend around the front portion of the fire fighter's head. The elastic material enables the semi-hood to stretch over and conform to the user's head creating an air tight seal therebetween. Straps 212 at the rear of the semi-hood aid in securing the face mask to the user's head. A clear plastic window 216 extends across a central opening in the semi-hood 210 in front of the fire fighter's face. The air hose 206 connects to a first port 214 at the chin area 215 of the face mask 208, thereby supplying air into the envelope formed by the mask.

Figure 2:
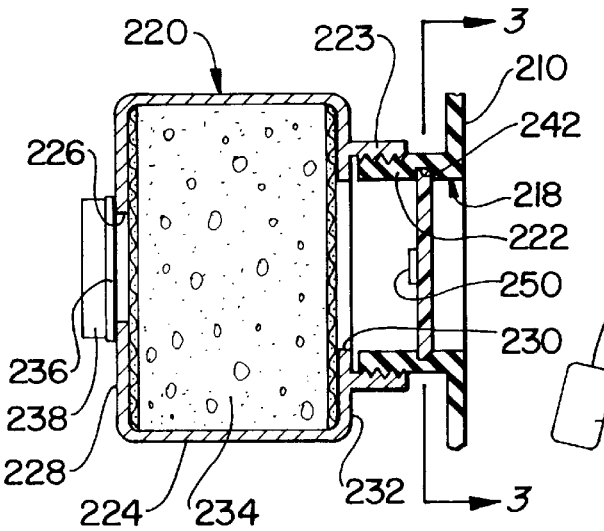
FIG. 2 illustrates the connection of the emergency air filtering system to the mask of FIG. 1.

With additional reference to FIG. 2, the face mask 208 also has a second port 218 for an emergency personal air filtering device 220. The second port 218 has tubular section 222 with external threads onto which an internally threaded outlet tube 223 of the filtering device 220 attaches, forming an air passage. The filtering device 220 can have or be connected to an adapter (not shown) for attaching to ports of different shapes and sizes.

The emergency personal air filtering device 220 comprises a filter canister 224 of a conventional puck-type design, having an inlet opening 226 in a front surface 228 and an outlet opening 230 in a rear surface 232. A filter element 234, similar to filter element 134 previously described, is contained within the canister 224 to remove particles, such as smoke and hazardous vapors from the air passing through the canister.

Prior to use a self-adhesive cover 236 is applied over the inlet opening 226 of the canister, thus providing an air-tight seal of that opening. A large tab 238 can be grasped by the fire fighter to pull the cover 236 off the filter canister 224 in order to use the air filtering device 220 in an emergency. The adhesive used will not permit the cover 236 to be reapplied over the inlet opening after the cover has been removed. Alternatively, use-evidencing tape, that leaves a message bearing residue, color coding or the like, for example along the perimeter of the inlet opening, can be employed as the inlet opening cover 236.

Figure 3:
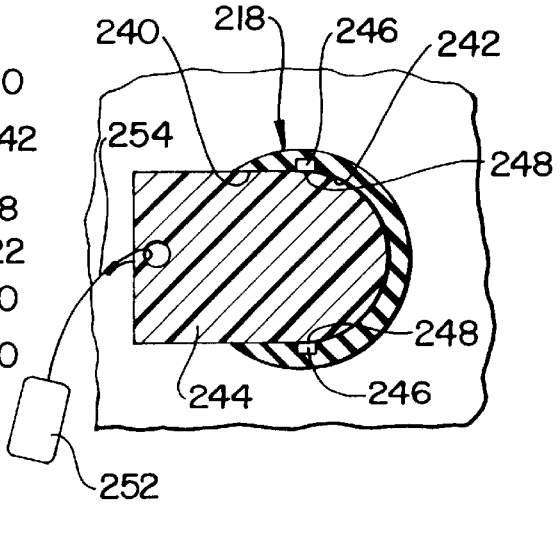
FIG. 3 is a cross-section view along line 3—3 in FIG. 2.

The air passage formed by the second port 218 of the face mask 208 also is closed prior to use of the emergency personal air filtering device 220. As shown in FIGS. 2 and 3, the second port 218 has a slot-like opening 240 on one side with a transverse internal groove 242 extending from this opening and across the interior of the second port. A plastic plate 244 is inserted into the groove 242 and snugly engages the groove to act as a valve member that provides an air-tight seal across the filtering device outlet. However, the plate is able to slide within the groove. The plate 244 has a pair of tabs 246 projecting from opposite sides into notches 248 in the side walls of the transverse groove 242 in the second port 218. The two tabs 246 are thinner than the main portion of the plate 244 and may have grooves cut along the interfaces between each tab and the main portion, enabling the tabs to break-away upon the fire fighter pulling on the plate to activate the air filtering device 220. A pull tab 252 is connected to the plate 244 by a wire 254 to aid the fire fighter in sliding the plate in an imminent life-threatening emergency. A lock tab 250 projects from a major surface of the plate 244 and prevents the plate from being removed from the second port 218.

As an alternative to the break-away tabs 249, a piece of single use tape, similar is character to the cover 238 may be applied between the plate 244 and the exterior surface of the face mask 208. This tape is pulled off either or both of the plate and the mask surface upon movement of the plate to open the second port 218. Alternatively, such tape could be adhered permanently to the plate and mask surface with the tape tearing upon movement of the plate to evidence use.

Normally the fire fighter receives air from the tank 202 through the first port of the face mask in FIG. 1. Should the fire fighter be unable to exit a hazardous environment before the air in the tank is depleted, the person removes the cover 238 from the inlet opening of the emergency personal air filtering device 220 and pulls plate 244 to open the second port 218 on the mask. This action enables the fire fighter to access a back-up source of breathable air upon depletion of the air in tank 202 during an imminent life-threatening emergency.

Both the cover 236 and the plate 244 provide mechanisms by which supervisory personnel can detect the use of the air filtering device and thereby the mechanisms discourage use in other than imminent life-threatening situations. In addition these use indicating mechanism are employed to detect which masks require replacement of their filtering device upon the return to the fire fighter's quarters.

Figure 4:
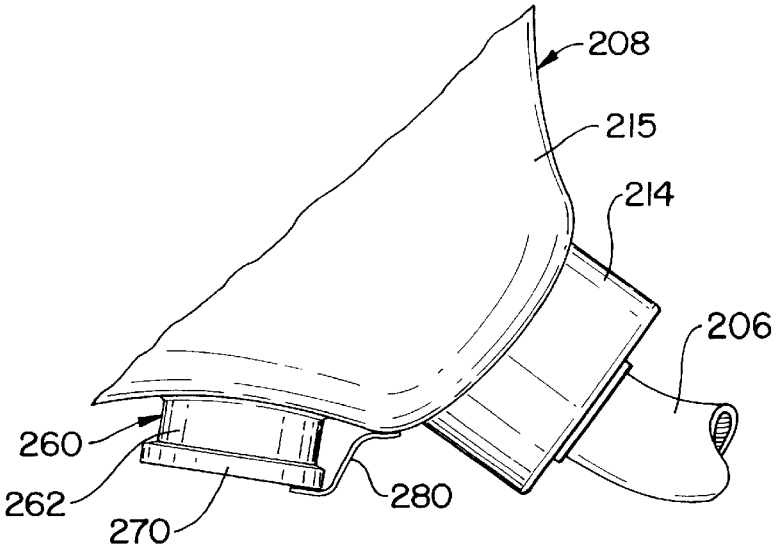
FIG. 4 is an enlarged view of the chin area of the face mask.
Figure 5:
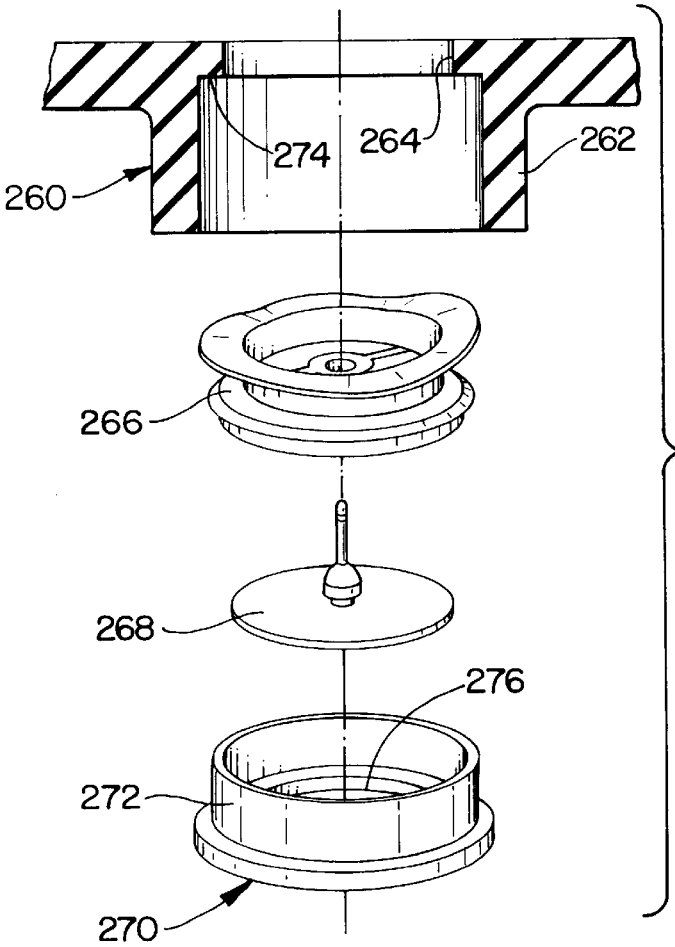
FIG. 5 is an exploded partial cross sectional view of an exhalation port at the chin area.

With reference to FIGS. 4 and 5, some face masks 208 also have an exhalation port 260 under the chin area 215, for example. The exhalation port 260 is formed by a short tubular projection 262 that communicates with an aperture 264 through the underside of the chin area 215. An exhalation valve body 266 is inserted into the tubular projection 262 until butting a rim 274 around the aperture 264 and then an exhalation flapper valve 268 is inserted against the valve body 266. The exterior open end of the tubular projection 262 is closed valve cap 270 which has an ring 272 that enters the tubular projection 262 and holds the exhalation valve body 266 and exhalation flapper valve 268 against the rim 274 of mask aperture 264. In other than an imminent life-threatening situation, a strip of adhesive tape 280 in FIG. 8 is applied between the valve cap 270 and the body of the face mask 208 to maintain the cap in this position. The valve cap 270 has apertures 276 therethrough to allow exhaust air to escape from the mask, as will be described.

In normal use of the face mask 208, when air is being supplied from the tank 202, the valve components 266 and 288 are compressed between the cap 270 and the face mask rim 274. In this state, the exhalation valve body 266 is biased by a constituent spring closing the exhalation port 260 when the fire fighter is inhaling air from the tank. The air pressure increase in the mask when the fire fighter exhales overcomes the force of the spring thereby opening the valve assembly to form an exhaust passage for the exhaled air.

In an imminent life-threatening situation when the air in the tank 202 has been depleted, the fire fighter pulls the valve cap 270 downward, in addition to activating the emergency air filtering device 220 described previously. A retaining mechanism (not shown) prevents the cap from being pulled completely from the tubular projection 262. This action causes the tape 270 either to tear or peel away from the cap or mask thereby providing evidence that the exhalation port was placed in a state in which to use the emergency air filtering device 220. Movement of the cap 270 in this manner releases the bias of the spring in the exhalation valve body 266 and thus the compression of the valve components between the cap and the mask aperture rim 274. With the spring bias released, the exhalation flapper valve 268 controls the opening and closing of the exhalation port 260 as the fire fighter breathes.

While specific embodiments of the invention have been set forth with a relatively high degree of particularity, it is intended that the scope of the invention not be so limited. Instead, the proper scope of the invention includes alternatives which are now within the purview of one skilled in the art. Thus, the scope should be ascertained by a reading of the claims that follow.

We claim:

1. A self-contained breathing apparatus for smoke inhalation protection for emergency response personnel in imminently life-threatening situations and for encouraging its limited use to imminently life-threatening situations, said apparatus comprising:

a mask to be worn over the face of a fire fighter, and having a first port connected to a hose through which breathable air is supplied to the mask and having a second port;

a personal air filtering device for smoke inhalation protection in imminent life-threatening situations upon depletion or failure of breathable air being supplied through the hose, said personal air filtering device comprising a canister having an inlet opening through which air enters and an outlet opening communicating with the second port of said mask, and a filter medium within said canister and through which air flows between the inlet opening and the outlet opening; and a first use-evidencing mechanism closing one of the inlet opening and the outlet opening of said canister, and operatively coupled to the one of said canister and said mask to indicate use of the personal air filtering device.

2. The self-contained breathing apparatus as recited in claim 1 wherein said first use-evidencing mechanism comprises a removable cover applied over the inlet opening in a manner which inhibits said cover from being reapplied after removal.

3. The self-contained breathing apparatus as recited in claim 1 wherein said first use-evidencing mechanism comprises a valve member releasably closing the second port of said face mask.

4. The self-contained breathing apparatus as recited in claim 3 wherein said use-evidencing mechanism comprises a tab extending from the valve member and breakable therefrom upon use of the personal air filtering device.

5. The self-contained breathing apparatus as recited in claim 1 further comprising a second use-evidencing mechanism closing the other of the inlet opening and the outlet opening of said canister, and operatively coupled to the other of said canister and said mask to indicate use of the personal air filtering device.

6. The self-contained breathing apparatus as recited in claim 5 wherein said second use-evidencing mechanism comprises a valve member releasably closing the second port of said face mask.

7. The self-contained breathing apparatus as recited in claim 1 wherein said mask further comprises:

an exhalation port with a valve mechanism having a first state when air is supplied to the mask through the first port and a second state when air is supplied to the mask through the second port; and another use-evidencing mechanism which indicates if the valve mechanism of the exhalation port has been placed into the second state.

8. A self-contained breathing apparatus for smoke inhalation protection for emergency response personnel in imminently life-threatening situations and for encouraging its limited use to imminently life-threatening situations, said apparatus comprising:

a mask to be worn over the face of an emergency response person, and having a first port connected to a hose through which breathable air is supplied to the mask and a second port;

a personal air filtering device for smoke inhalation protection in imminent life-threatening situations upon depletion or failure of breathable air being supplied through the hose, said personal air filtering device comprising a canister having an inlet opening through which air enters and an outlet opening communicating with the second port of said mask, and a filter medium within said canister and through which air flows between the inlet opening and the outlet opening; and a first use-evidencing mechanism sealing the inlet opening of said canister and operatively coupled to the canister to indicate use of the personal air filtering device.

9. The self-contained breathing apparatus as recited in claim 8 wherein said first use-evidencing mechanism comprises a removable cover applied over the inlet opening in a manner which inhibits said cover from being reapplied after removal.

10. The self-contained breathing apparatus as recited in claim 8 further comprising a valve member releasably sealing the second port of said face mask.

11. The self-contained breathing apparatus as recited in claim 10 further comprising a second use-evidencing mechanism operatively coupled to the valve member to indicate use of the personal air filtering device.

12. The self-contained breathing apparatus as recited in claim 11 wherein said second use-evidencing mechanism comprises a tab extending from the valve member and breakable therefrom upon use of the personal air filtering device.

13. The self-contained breathing apparatus as recited in claim 8 wherein said mask further comprises:

an exhalation port with a valve mechanism having a first state when air is supplied to the mask through the first port and a second state when air is supplied to the mask through the second port; and another use-evidencing mechanism which indicates if the valve mechanism of the exhalation port has been placed into the second state.

14. A method for storing and preparing a self-contained breathing apparatus for smoke inhalation protection for emergency response personnel in imminently life-threatening situations and for encouraging its limited use to imminently life-threatening situations, said method comprising the steps of:

configuring a smoke filter in a use-evidencing manner so that employment of the smoke filter for breathing is permanently indicated;

attaching a conduit between a first port of a face mask of the apparatus and a tank of breathable air;

attaching the smoke filter to a second port of the face mask to filter air breathed by the fire fighter when the tank of breathable air is depleted.

15. The method as recited in claim 14 wherein the step of attaching the smoke filter comprises releasably sealing the second port with a use-evidencing mechanism operatively coupled to the second port to indicate use of the smoke filter.

16. The method as recited in claim 15 wherein the step of attaching the smoke filter further comprises placing a releasable cover over an inlet opening of the smoke filter wherein the releasable cover includes a use-evidencing mechanism operatively coupled to indicate use of the smoke filter.

17. The method as recited in claim 14 wherein the step of attaching the smoke filter comprises placing a releasable cover over an inlet opening of the smoke filter wherein the releasable cover includes a use-evidencing mechanism operatively coupled to indicate use of the smoke filter.

18. A method for storing and preparing a personal air filtering device for smoke inhalation protection for a fire fighter in imminently life-threatening situations and for encouraging its limited use by the fire fighter to the imminently life-threatening situations, said method comprising the steps of:

configuring a smoke filter with a use-evidencing mechanism so that use of the smoke filter for breathing is permanently indicated;

providing the fire fighter with a self-contained breathing apparatus including a face mask having a first port connected by conduit to a tank of breathable air for primary use during exposure to a non-breathable environment, and a second port to which the smoke filter in connected to filter air breathed by the fire fighter when the tank of breathable air is depleted;

said fire fighter, when in a non-breathable environment, primarily using said self-contained breathing apparatus to breathe air from said tank;

said fire fighter, upon depletion of air in the tank, activating the smoke filter as a source of breathable air wherein the activating involves breaching said use-evidencing mechanism to access said smoke filter, whereby use of said smoke filter is evidenced;

after exiting the non-breathable environment, a third party inspecting the use-evidencing mechanism; and said fire fighter accounting for use of said smoke filter.

* * * * *